US008690261B2

(12) United States Patent
Tang

(10) Patent No.: US 8,690,261 B2
(45) Date of Patent: Apr. 8, 2014

(54) HYDRAULIC RESONANT BREAKING HAMMER

(76) Inventor: Zhongsheng Tang, Nanning (CN)

( * ) Notice: Subject to any disclaimer, the term of this patent is extended or adjusted under 35 U.S.C. 154(b) by 0 days.

(21) Appl. No.: 13/322,402

(22) PCT Filed: Dec. 31, 2010

(86) PCT No.: PCT/CN2010/002229

§ 371 (c)(1),
(2), (4) Date: Nov. 23, 2011

(87) PCT Pub. No.: WO2011/120210

PCT Pub. Date: Oct. 6, 2011

(65) Prior Publication Data

US 2013/0015696 A1 Jan. 17, 2013

(30) Foreign Application Priority Data

Mar. 30, 2010 (CN) ..... 2010 1 0135284
Mar. 30, 2010 (CN) ..... 2010 2 0144576 U

(51) Int. Cl.
*E21C 25/02* (2006.01)

(52) U.S. Cl.
CPC ..... *E21C 25/02* (2013.01)
USPC ..... 299/37.2; 299/37.3

(58) Field of Classification Search
USPC ..... 299/37.2, 37.3
See application file for complete search history.

(56) References Cited

U.S. PATENT DOCUMENTS 3,866,693 A * 2/1975 Century ..... 173/49
4,330,156 A * 5/1982 Gurries ..... 299/37.2
4,374,602 A * 2/1983 Gurries et al. ..... 299/37.5
4,645,016 A * 2/1987 Barnes ..... 173/209
5,004,166 A * 4/1991 Sellar ..... 241/36
6,378,951 B1 * 4/2002 Bouyoucos et al. ..... 299/37.2

FOREIGN PATENT DOCUMENTS

| | | | |
|---|---|---|---|
| CN | 2360441 | Y | 1/2000 |
| CN | 2688815 | Y | 3/2005 |
| CN | 3481445 | Y | 10/2005 |
| CN | 2903169 | Y | 5/2009 |
| CN | 201358483 | Y | 12/2009 |
| CN | 201358484 | Y | 12/2009 |
| CN | 101793041 | A | 8/2010 |
| DE | 3523219 | C1 | 6/1986 |

OTHER PUBLICATIONS

International Search Report for PCT/CN2010/002229, dated Dec. 31, 2010 (4 pgs.).

* cited by examiner

*Primary Examiner* — David Bagnell
*Assistant Examiner* — Michael Goodwin
(74) *Attorney, Agent, or Firm* — Shumaker & Sieffert, P.A.

(57) ABSTRACT

A hydraulic resonant breaking hammer is described that includes a hydraulic driving system, a vibration exciter, a control system, a linkage mechanism and a breaking hammer head. The hydraulic driving system includes a hydraulic motor, an electric-control hydraulic distributing valve, a hydraulic pump and an engine. The vibration exciter includes a box and at least one group of eccentric wheels. The control system includes a sensor, a microcomputer controller and the electric-control hydraulic distributing valve. The linkage mechanism includes a machine frame, a guide rail and a damper spring. The disclosure solves the problems of the existing engineering breaking devices, such as low efficiency, high noise, serious damages to the driving excavator caused by the reaction of an impact force and incapability of breaking large rocks.

1 Claim, 2 Drawing Sheets

HYDRAULIC RESONANT BREAKING HAMMER

FIELD OF THE INVENTION

The present invention relates to an engineering machine, in particular to an engineering breaking device.

BACKGROUND OF THE INVENTION

At present, the hydraulic breaking hammers used in engineering projects have the power source from excavators, loaders or pumping stations. The working principles for the driving include full-hydraulic type, hydraulic-pneumatic combination type, nitrogen explosion type and so on, in which steel chisels are driven by the piston motion to generate on rocks the impact force by which the rocks are broken. For example, the above technologies can be seen in Chinese patent publication number CN2688815, the title of which is "Hydraulic Breaking Hammers for Engineering Trucks", and Chinese patent publication number CN3481445, the title of which is "Hydraulic Breaking Hammers", and so on. The above technologies have the advantages of applications in a wide range and easy operation; however, they have shortages, such as low efficiency, high noise, serious damages to the driving excavator caused by the reaction of the impact force and incapability of breaking large rocks.

SUMMARY OF THE INVENTION

The purpose of the present invention is to provide a hydraulic resonant breaking hammer, to solve the problems of the existing engineering breaking devices, such as low efficiency, high noise, serious damages to the driving excavator caused by the reaction of the impact force and incapability of breaking large rocks.

The present invention solves the above technical problems by the following technical solution: a hydraulic resonant breaking hammer of the present invention comprising a hydraulic driving system, a vibration exciter 2, a control system, a linkage mechanism and a breaking hammer head 3.

The hydraulic driving system consists of a hydraulic motor 1, an electric-control hydraulic distributing valve 12, a hydraulic pump 13 and an engine 14. The output end of the engine 14 is connected to the hydraulic pump 13, the output end of the hydraulic pump 13 is connected to the electric-control hydraulic distributing valve 12, and the output end of the electric-control hydraulic distributing valve 12 is connected to the hydraulic motor 1. The engine 14 drives the hydraulic pump 13 to generate pressure oil, which is regulated by the electric-control hydraulic distributing valve 12 and output to the hydraulic motor 1, therefore to drive the hydraulic motor 1 to rotate.

The vibration exciter 2 consists of a box 4 and at least one group of eccentric wheels consisting of two eccentric wheels which are arranged symmetrically on left and right sides and installed in the box and the rotating shafts of which are provided with a pair of gears 11 engaged with each other, in which the rotating shaft of one of the eccentric wheels is connected to the hydraulic motor 1. The hydraulic motor drives the rotating shaft of said one of the eccentric wheels to rotate, via the gears that are engaged with each other, to achieve reverse synchronous rotation of the two eccentric wheels.

The control system consists of a sensor 16, a microcomputer controller 17 and the electric-control hydraulic distributing valve 12. The sensor 16 is installed on a machine frame 7, the output end of the sensor 16 is connected to the microcomputer controller 17, and the output end of the microcomputer controller 17 is connected to the electric-control hydraulic distributing valve 12. The sensor 16 senses the vibration feedback of rocks being broken and inputs feedback signals to the microcomputer controller 17, the microcomputer controller 17 analyzes the vibration situation of rocks to find out the natural frequency of the rocks being broken, the microcomputer controller 17 outputs corresponding control signals to the electric-control hydraulic distributing valve 12. The electric-control hydraulic distributing valve 12 can adjust the flow rate output to the hydraulic motor 1, and control the rotation speed of the hydraulic motor 1 by controlling the flow rate output to the hydraulic motor 1, thus to control the vibration frequency of the vibration exciter 2.

The linkage mechanism consists of the machine frame 7, a guide rail 9 and a damper spring 8. The machine frame 7 is installed on a fore arm 10 of an excavator, the guide rail 9 is arranged on the machine frame 7, the box 4 of the vibration exciter 2 is arranged on the guide rail 9 and forms an up-and-down sliding fit with the guide rail 9, and the damper spring 8 is connected between the upper part of the box 4 and the machine frame 7.

The breaking hammer head 3 is arranged at the lower part of the box 4.

The breaking hammer head 3 is of a tapered structure.

The hydraulic resonant breaking hammer according to the present invention is a breaking machine that has high efficiency, low noise, capability of breaking large rocks and slight damages to the main mechanism. The machine breaks rocks by means of resonant vibration instead of impact force.

The hydraulic resonant breaking hammer according to the present invention has the advantages of high working efficiency, low noise, no damages to the driving excavator and capability of breaking larger rocks.

Figure 1:
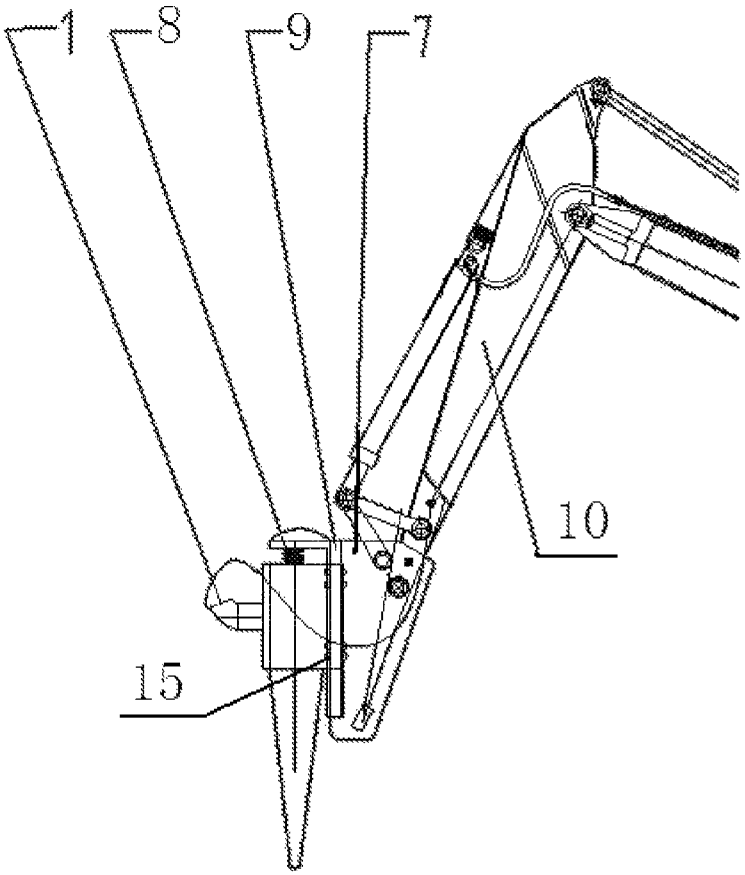
FIG. 1 is a structural schematic view of a hydraulic resonant breaking hammer installed on an excavator according to the present invention.

In the drawings: hydraulic motor 1, vibration exciter 2, breaking hammer head 3, box 4, machine frame 7, damper spring 8, guide rail 9, fore arm 10 of an excavator, gears 11, electric-control hydraulic distributing valve 12, hydraulic pump 13, engine 14, pulley 15, sensor 16, microcomputer controller 17.

DETAILED DESCRIPTION OF THE EMBODIMENTS

The present invention will be described in details below by means of an optimal embodiment in conjunction with the drawings.

Figure 2:
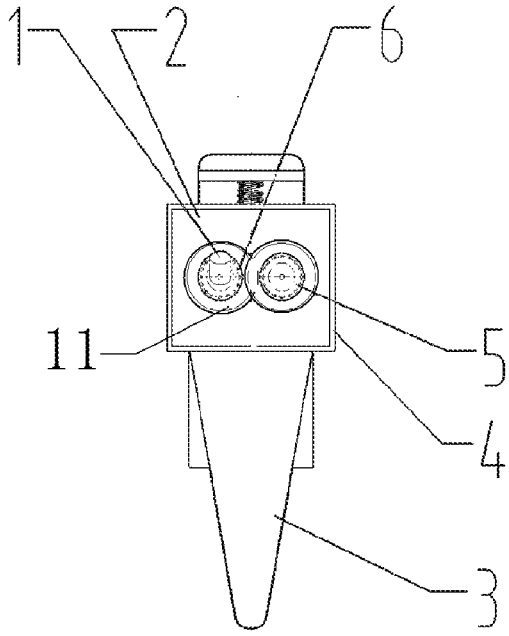
FIG. 2 is a left schematic view of the hydraulic resonant breaking hammer in FIG. 1.
Figure 3:
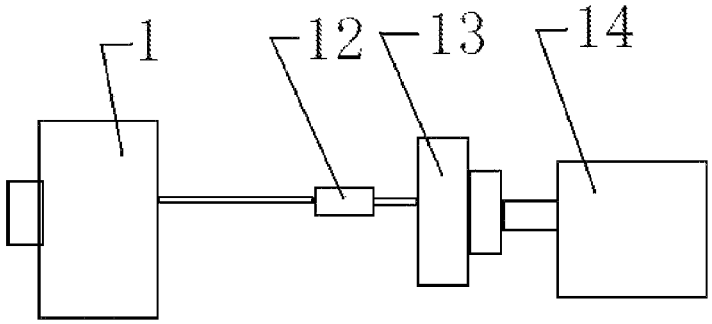
FIG. 3 is a structural schematic view of a hydraulic driving system employed in the present invention.
Figure 4:
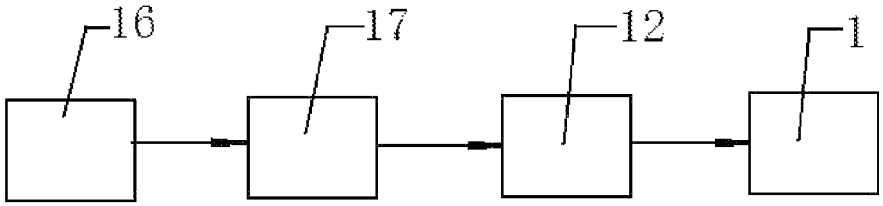
FIG. 4 is a structural schematic view of a control system employed in the present invention.

With reference to FIG. 1 to FIG. 4, a hydraulic resonant breaking hammer of the present invention comprises a hydraulic driving system, a vibration exciter 2, a control system, a linkage mechanism and a breaking hammer head 3. The hydraulic driving system consists of a hydraulic motor 1, an electric-control hydraulic distributing valve 12, a hydraulic pump 13 and an engine 14. The output end of the engine 14 is connected to the hydraulic pump 13, the output end of the hydraulic pump 13 is connected to the electric-control hydraulic distributing valve 12, and the output end of the electric-control hydraulic distributing valve 12 is connected to the hydraulic motor 1. The vibration exciter 2 consists of a box 4 and a group of eccentric wheels consisting of a first eccentric wheel and a second eccentric wheel which are arranged symmetrically on left and right sides and installed in the box, and the rotating shafts of which are arranged on the box 4 through bearings and provided with gears 11 engaged with each other. The rotating shaft of the second eccentric wheel is connected to the hydraulic motor 1. The linkage mechanism consists of the machine frame 7, a guide rail 9 and a damper spring 8. The machine frame 7 is installed on a fore arm 10 of an excavator, the guide rail 9 is arranged on the machine frame 7, the box 4 of the vibration exciter 2 is arranged on the guide rail 9 through a pulley 15 and forms an up-and-down sliding fit with the guide rail 9, and the damper spring 8 is connected between the upper part of the box 4 and the machine frame 7. The breaking hammer head 3 is arranged at the lower part of the box 4. The breaking hammer head 3 is of a tapered structure. The control system consists of a sensor 16, a microcomputer controller 17 and the electric-control hydraulic distributing valve 12. The sensor 16 is installed on a machine frame 7, the output end of the sensor 16 is connected to the microcomputer controller 17, and the output end of the microcomputer controller 17 is connected to the electric-control hydraulic distributing valve 12, and the electric-control hydraulic distributing valve 12 is connected to the hydraulic motor 1.

The function of the control system lies in: the sensor 16 senses the vibration feedback of rocks being broken and inputs feedback signals to the microcomputer controller 17, the microcomputer controller 17 analyzes the vibration situation of rocks to find out the natural frequency of the rocks being broken, the microcomputer controller 17 outputs corresponding control signals to the electric-control hydraulic distributing valve 12. The electric-control hydraulic distributing valve 12 can adjust flow rate output to the hydraulic motor 1, and control the rotation speed of the hydraulic motor 1 by controlling the flow rate output to the hydraulic motor 1, thus to control the vibration frequency of the vibration exciter 2, and finally automatically adjusting the vibration frequency of the breaking hammer head 3, such that the vibration frequency approximates to the natural frequency of the rocks being broken. As a result, the rocks being broken generate the resonance within the local area under the breaking hammer head 3, to reduce the internal friction force in rocks quickly, thus to break the rocks easily.

The function of the hydraulic driving system lies in: the engine 14 drives the hydraulic pump 13 to generate pressure oil, which is regulated by the electric-control hydraulic distributing valve 12 and output to the hydraulic motor 1, therefore to drive the hydraulic motor 1 to rotate.

The function of the vibration exciter 2 lies in: the hydraulic motor 1 drives the rotating shaft of the second eccentric wheel to rotate, via a pair of gears 11 that are engaged with each other, to bring the rotating shaft of the first eccentric wheel to rotate at the same time, thus to achieve reverse synchronous rotation of the first eccentric wheel and the second eccentric wheel. When in operation, the two eccentric wheels generate centrifugal forces, components of which in the direction of the central line connecting the centers of the rotating shafts counteract with each other at the same time, while components of which in the direction perpendicular to the central line of the rotating shafts are added up to form an excitation force. The excitation force is transferred to the breaking hammer head 3 through the box 4, and the breaking hammer head 3 is in contact with the rocks being broken, to transfer the energy to the rocks.

The number of the groups of eccentric wheels of the vibration exciter 2 is not limited to one; and there may be two or more groups of eccentric wheels.

The main function of the linkage mechanism lies in that the vibration exciter 2 is linked to the fore arm 10 of the excavator. The box 4 of the vibration exciter 2 can slide up and down on the guide rail 9 through the pulley 15, and the top part of the box is connected to the machine frame 7 through the damper spring 8. In this way, when the hydraulic resonant breaking hammer is in operation, it can be avoided that the impact energy is transferred to the excavator through the machine frame 7.

The present invention is not limited to the above embodiment. Various improvements and modifications can be made within the principle of the present invention, and those improvements and modifications should be covered by the protection scope of the present invention.

What is claimed is:

1. A hydraulic resonant breaking hammer comprising a hydraulic driving system, a vibration exciter, a control system, a linkage mechanism and a breaking hammer head, wherein:

the hydraulic driving system consists of a hydraulic motor, an electric-control hydraulic distributing valve, a hydraulic pump and an engine, the output end of the engine is connected to the hydraulic pump, the output end of the hydraulic pump is connected to the electric-control hydraulic distributing valve, and the output end of the electric-control hydraulic distributing valve is connected to the hydraulic motor;

the vibration exciter consists of a box and at least one group of eccentric wheels consisting of two eccentric wheels which are arranged symmetrically on left and right sides and installed in the box, and the rotating shafts of which are provided with a pair of gears engaged with each other in which the rotating shaft of one of the eccentric wheels is connected to the hydraulic motor;

the control system consists of a sensor, a microcomputer controller and the electric-control hydraulic distributing valve, the sensor is installed on a machine frame, the output end of the sensor is connected to the microcomputer controller, and the output end of the microcomputer controller is connected to the electric-control hydraulic distributing valve;

the sensor senses the vibration feedback of rocks being broken and inputs feedback signals to the microcomputer controller, the microcomputer controller analyzes the vibration situation of rocks to determine a natural frequency of the rocks being broken, the microcomputer controller outputs corresponding control signals to the electric-control hydraulic distributing valve to automatically adjust a vibration frequency of the breaking hammer head to make the vibration frequency approximate to the natural frequency of the rocks being broken;

the linkage mechanism consists of the machine frame, a guide rail and a damper spring, the machine frame is installed on a fore arm of an excavator, the guide rail is arranged on the machine frame, the box of the vibration exciter is arranged on the guide rail and forms an up-and-down sliding fit with the guide rail, and the damper spring is connected between the upper part of the box and the machine frame; and the breaking hammer head is arranged at the lower part of the box, wherein the breaking hammer head is of a tapered structure.

* * * * *